United States Patent [19]

Kaup et al.

[11] 3,935,088

[45] Jan. 27, 1976

[54] ELECTROPHORETIC ENAMELLING OF FERROUS ARTICLES

[75] Inventors: Friedel Kaup, Gutersloh; Heinrich Warnke, Marienfeld, both of Germany

[73] Assignee: Miele & Cie, Gutersloh, Germany

[22] Filed: Sept. 4, 1973

[21] Appl. No.: 393,823

Related U.S. Application Data

[63] Continuation-in-part of Ser. No. 179,203, Sept. 9, 1971, abandoned.

[30] Foreign Application Priority Data

Sept. 12, 1970 Germany ..... 2045265

[52] U.S. Cl. ..... 204/181

[51] Int. Cl.[2] ..... C25D 13/02; C25D 13/20

[58] Field of Search ..... 204/181

[56] References Cited

UNITED STATES PATENTS

| | | | |
|---|---|---|---|
| 3,467,589 | 9/1969 | Rausch et al. | 204/181 |
| 3,470,072 | 9/1969 | Ransome et al. | 204/181 |
| 3,575,838 | 4/1971 | Hughes | 204/181 |

*Primary Examiner*—Howard S. Williams
*Attorney, Agent, or Firm*—Fleit & Jacobson

[57] ABSTRACT

A vitreous enamel-coated ferrous article is prepared by (a) pretreating a ferrous article such as by pickling, (b) coating the pretreated ferrous article with a metal whose boiling temperature is above the firing temperature of the enamel, (c) electrophoretically coating the metal-coated article with a vitreous enamel, and (d) firing the enamel.

8 Claims, No Drawings

ELECTROPHORETIC ENAMELLING OF FERROUS ARTICLES

CROSS-REFERENCE TO RELATED APPLICATION

This application is a continuation-in-part of parent application Ser. No. 179,203, filed Sept. 9, 1971, entitled ELECTROPHORETIC ENAMELLING OF FERROUS ARTICLES, now abandoned.

The present invention relates to a vitreous enamel-coated article of manufacture and to a method for electrophoretically coating vitreous enamel on ferrous parts, particularly steel.

A method is known for the electrophoretic coating of steel parts with enamel. This method suffers from the disadvantage that the enamelled articles are not of a satisfactory white color. The reason for this is that nickel and iron are oxidized due to the anodic polarity of the articles being enamelled. This oxidation causes discoloration of the deposited enamel. In addition, the dross in the enamelling container is discolored due to this oxidation after the enamelling of several articles, and a brown or yellow coloration occurs. There is also the disadvantage that a part of the nickel necessary for adhesion of the enamel is lost.

It is therefore an object of the present invention to provide an improved vitreous enamel-coated article and enamelling method which overcomes the above-mentioned disadvantages.

In the enamelling method according to the present invention, the ferrous part is first pretreated in a conventional manner, such as degreasing, pickling, nickel-plating or the like. Before the electrophoretic coating step, the ferrous part, in particular a steel part, is coated with zinc or copper. Instead of zinc or copper, it is also possible to use any metal with a boiling temperature above the firing temperature of the vitreous enamel. It is advantageous to use a metal having oxidation products which are white or substantially white. Particularly good results are achieved when using a zinc coating with a thickness of from 0.3 to 5 g/sq. m. of surface area on a copper coating with a thickness of from 0.01 to 2 g/sq. m. of surface area.

The method of the present invention has the particular advantage that the deposited enamel and the dross in the enamelling container do not change color, even after prolonged use. The method according to the present invention therefore avoids nickel and iron being oxidized by the anodic polarity of the articles being enamelled. If there is sufficient zinc on copper on the surface of the ferrous material or steel, the zinc or copper is oxidized instead of the ferrous material and the nickel. The resulting zinc or copper oxide, or zinc or copper hydroxide is white, however, and does not result in any change in color.

Due to the relatively high electrolyte content of the dross, gas reactions occur both at the cathode and at the workpiece (anode). The escaping gases very often cause bubbles in the enamel or partially dissolve the enamel. Due to the metal coating on the surface of the steel part in accordance with the present invention, these gas reactions can be suppressed to such an extent that neither bubbles in the deposited enamel or loosened enamel coatings any longer occur.

In the previously known electrophoretic enamelling methods, the variables of the dross such as specific weight, temperature, conductivity, grinding additives and the like, had to be kept within very narrow limits.

Due to the interposed metal layer, in particular zinc or copper, the variables of the dross can be varied within wide limits.

Since no material gas reactions occur with the zinc or copper-coated steel parts during the electrophoretic coating step, the conductivity of the dross can be increased by increased addition of electrolyte. Increasing the conductivity improves the distribution and shaped parts can therefore be better enamelled.

The improved distribution also provides for an improved control of the thickness of the coating when enamelling shaped parts. Excessive accumulation of enamel at exposed places is avoided. Faraday forces no longer have the action as in the case of steel parts which are not zinc or copper-coated.

A further advantage is that the electrophoretically applied coating adheres better to the steel parts. The coating no longer slips off during rinsing after the electrophoretic coating step or even directly after the electrophoretic coating step.

In accordance with the method of the present invention, the steel surface or the nickel-plated steel surface is covered by an additional metal coating, in particular zinc or copper. The exact thickness of the coating depends on the deposition equivalent of the dross and the required thickness of the coating of vitreous enamel. The coating of metal applied should, however, not be too thick, for otherwise the enamel adhesion is poor. In the case of zinc, a coating of from 0.3 to 5 g/sq. m. of surface area has been found to be desirable when using a titanium-white enamel with a thickness of about 0.12 mm.

After the pretreated ferrous part is coated with zinc, copper or other metal, the metal-coated article is electrophoretically fired-on opaque glassy coatings conventionally used on steel or other metals and sometimes referred to as "porcelain enamel." More specifically, the vitreous enamel can be such inorganic glass-forming substances as quartz, feldspar, boric acid, borax, $Na_2O$, $K_2O$, lead oxide, PbO, aluminum oxide and titanium-white enamel. The enamel is fired at conventional temperatures normally ranging from 500° to 900°C and typically above 800°C.

What is claimed is:

1. A method for the electrophoretic coating of a ferrous article with a vitreous enamel comprising the steps of (a) coating said article with from 0.3 to 5 g/sq. m. of zinc or 0.01 to 2 g/sq. m. of copper, (b) electrophoretically coating the metal-coated article with vitreous enamel, and (c) firing said enamel.

2. The method of claim 1 wherein said ferrous article is a steel article.

3. The method of claim 1 and further comprising pretreating said article prior to coating said article with said metal.

4. The method of claim 3 wherein said pretreatment is degreasing, pickling or nickel plating.

5. The method of claim 1 wherein said vitreous enamel is quartz, feldspar, boric acid, borax, $Na_2O$, $K_2O$, lead oxide, PbO, aluminum oxide, or titanium-white enamel.

6. The method of claim 1 wherein said enamel is fired at 500° to 900°C.

7. A vitreous enamel-coated article of manufacture comprising a ferrous part, from 0.3 to 5 g/sq. m. of zinc or 0.01 to 2 g/sq. m. of copper coated on said ferrous part, said zinc or copper being at least partially oxidized, and a fired-on vitreous enamel electrophoretically coated on the metal-coated part.

8. The article of claim 7 wherein said vitreous enamel is quartz, feldspar, boric acid, borax, $Na_2O$, $K_2O$, lead oxide, PbO, aluminum oxide, or titanium-white enamel.

* * * * *